United States Patent [19]

Fasig

[11] 4,331,328

[45] May 25, 1982

[54] CONTROLLER FOR A SERVO DRIVEN DOCUMENT FEEDER

[75] Inventor: Harold A. Fasig, Plymouth, Mich.

[73] Assignee: Burroughs Corporation, Detroit, Mich.

[21] Appl. No.: 164,004

[22] Filed: Jun. 30, 1980

[51] Int. Cl.[3] ..... B65H 5/34

[52] U.S. Cl. ..... 271/270; 198/461; 198/575; 198/577; 271/111; 271/259

[58] Field of Search ..... 271/270, 202, 203, 110, 271/111, 114, 314, 265, 259, 258, 272, 273, 274; 198/460, 461, 575, 577, 579, 572

[56] References Cited

U.S. PATENT DOCUMENTS

| | | | |
|---|---|---|---|
| 3,490,687 | 1/1970 | Bowman | 198/460 X |
| 3,825,251 | 7/1974 | Beery et al. | 271/258 |
| 3,827,545 | 8/1974 | Buhayar | 271/203 X |
| 4,113,244 | 9/1978 | Ruenzi | 271/270 X |

FOREIGN PATENT DOCUMENTS

| | | | |
|---|---|---|---|
| 2030116 | 4/1980 | United Kingdom | 271/202 |

*Primary Examiner*—Bruce H. Stoner, Jr.
*Attorney, Agent, or Firm*—Delbert P. Warner; Charles E. Quarton; Kevin R. Peterson

[57] ABSTRACT

System for controlling a document feeder which receives documents of various lengths one-at-a-time with their ends touching or overlapping and delivers them at a constant speed and with fixed spaces between their ends. The document feeder employs a variable speed servo, which drives a group of low-speed rollers and a group of high-speed rollers while maintaining a constant speed ratio between the two groups. A natural gap develops between first and second documents in a track of the feeder between the time the first document and the second document pass from control by the group of low-speed rollers into control by the group of high-speed rollers. Sensors are positioned along the track to detect passage of trailing and leading edges of successive documents. A processor responds to signals from the sensors to determine the length of the natural gap formed between the first and second documents and adjusts the speed of the servo system to change the gap, if needed, and then adjusts the speed to match that of rollers in the track downstream of the document feeder. Performance of the system is monitored by measurement of the gap downstream and changes in signals to the processor which accompany changes in the gap downstream are used to adjust the gap to the desired length.

8 Claims, 6 Drawing Figures

CONTROLLER FOR A SERVO DRIVEN DOCUMENT FEEDER

CROSS REFERENCE TO RELATED APPLICATIONS

A. U.S. patent application Ser. No. 110,593, filed Jan. 9, 1980 in the name of Daniel D. Alper, entitled "Feeder For Delivering Documents With Constant Speed And Spacing" and assigned to the same assignee as the present invention, is hereby incorporated by reference. U.S. patent application Ser. No. 155,053 entitled "Track Sensor Controller", which was filed in the names of Harold A. Fasig and Eugene E. Paananen on June 2, 1980 and assigned to the same assignee as the present invention, is hereby incorporated by reference.

BACKGROUND OF THE INVENTION

1. Field of the Invention

The invention relates to the control of document feeding devices. It relates particularly to means for controlling the transfer of documents of various lengths in a manner establishing and maintaining substantially constant gaps between documents while delivering the documents at a constant speed.

2. Description of the Prior Art

It is highly desirable that document feeding devices supply documents at a constant speed and with constant spacing, or gaps, between them in order to enable sorting equipment downstream of the feeder to provide improved throughput of documents.

Some prior art document feeders have depended on stopping and starting rollers at various times to control spaces between documents. That procedure has been hard on the documents and has tended to wear the mechanisms of the feeders excessively as well as to be inefficient in the use of energy. For high-speed, short-gap feeding systems, the large accelerating forces required to speed up or slow down such an intermittently driven system are unrealistically high.

Among the known prior art devices is a "Constant Spacing Document Feeder" disclosed in U.S. patent application Ser. No. 111,804 filed Jan. 14, 1980 as a continuation of application Ser. No. 942,469 (now abandoned) which uses an approximation method for gap control in which the feeding elements operate between two substantially different speeds. While that system serves to eliminate the need to bring the feeding elements to a complete stop, it typically requires changes in speed twice for every document, resulting in high stresses and high energy consumption. It will be noted also that while that method has the effect of substantially cutting down on gap variation, it is not sufficiently exact for some purposes and does not provide the level of gap control possible with the present constant spacing feeder. Furthermore, documents processed by that prior art apparatus are often released to the constant speed portion of the system at speeds other than the transport speeds so a secondary uncontrolled acceleration occurs after there has been a gap adjustment, which adds further to undesirable variations in gap length.

SUMMARY OF THE INVENTION

A document feeder, according to the present invention, embodies a control system, or controller, enabling the feeder to deliver intermixed documents of variable length into a transporter track at a constant speed and with a uniform gap between documents. As indicated previously, the supply of documents at a constant speed and especially with uniform spacing between documents enables sorting equipment downstream of the feeder to provide improved throughput of documents.

To accomplish the foregoing, documents are fed into the feeder of concern in the present invention from a pair of rollers serving as a scrubber and feeder which separate bundled documents received from a jogger so that they advance substantially one-at-a-time into the feeder. The feeder embodies a first plurality of rollers arranged in a track which are driven by a servo motor at variable speeds determined by the controller. A second plurality of rollers in the same track is driven at higher speeds, and at a constant speed ratio to that of the first rollers, through a mechanical drive train by the same servo motor. A third plurality of rollers in the track is driven at a constant transport speed by a separate motor. Reference may be made to the above identified U.S. patent application Ser. No. 110,593 for a more detailed description of mechanical aspects of the foregoing.

The first plurality of rollers of the feeder, forming a low speed section, include pairs of rollers aligned along a track to accept a succession of documents from the scrubber-feeder and pass them along end-to-end down the track. The second plurality of rollers, forming a high-speed section in the track, include a first pair of rollers which accept a first document and increase its linear speed to match that of the peripheral speed of the second plurality of rollers. A second document, still travelling between the first plurality of rollers, will continue to move more slowly and a gap will form between the first and the second document. This gap will progressively increase in length until the second document reaches and is controlled by the second plurality of rollers at which time the gap temporarily will become of fixed length.

First sensing means located in the track immediately following the first pair of rollers in the high-speed section detects when the leading and trailing edges of the first document pass. This first sensing means also detects when the leading edge of the second document passes, indicating thereby that it has been seized by the first pair of rollers in the high-speed section, which are designed to override the influence of rollers in the low-speed section which still contact the document. At this time, the gap between the first and second document becomes of fixed length, since the documents then move at the same speed. Signals from the first sensing means are employed by the control system to determine the length of the gap existing between the first and second documents at the time the said leading edge of the second document passes the first sensor.

The speed of the second plurality of rollers at this time is such as to match the constant transport speed of the third set of rollers. The third set of rollers therefore is able to accept the first document which is travelling at the transport speed and transport it at the constant transport speed.

As the trailing edge of the first document clears the rollers in the high speed section, it also clears a second sensor in the track which provides a signal to the controller marking its passage. The controller then calculates what correction to make, if any, to establish the length of a preferred gap and adjusts the speed of the second set of rollers to provide further adjustments of the gap between the first and second documents until a desired preferred or standard gap is attained. Then, it returns the second set of rollers to the constant transport speed to enable a smooth transfer of the second document to the third set of rollers. The attained preferred or standard gap between the first and second documents then can be maintained in the downstream track. Gaps between the second and third documents, the third and fourth documents, and subsequent pairs of documents are adjusted in the same way.

The controller monitors the performance of the system through sensors positioned downstream which function as part of a secondary feedback system as they measure the gap at those positions downstream. The controller uses that information to make adjustments in the original standard gaps to compensate for variations in the gaps downstream due to such factors as wear, friction, document slippage, differences in motor characteristics, faulty tolerances or any other physical characteristics causing variations in gap lengths.

DESCRIPTION A PREFERRED EMBODIMENT

Figure 1:
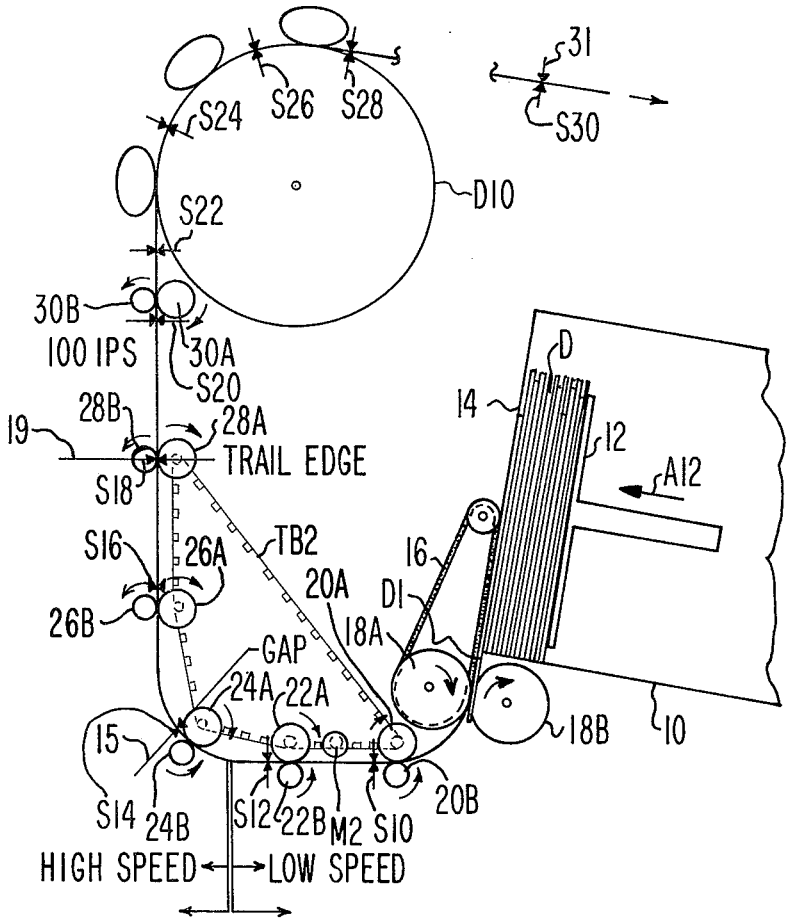
FIG. 1 depicts the arrangement of elements in a document sorting machine of a kind controlled by controllers according to the present invention.

Turning first to FIG. 1, a plan view is shown of a document sorter of the kind controlled by apparatus according to the present invention.

The sorter includes a document hopper at 10 having a flag at 12 which urges documents shown at D in the direction of the arrow A12 against the end of the hopper at 14 and into contact with a feeder belt at 16. The belt 16 drives documents, such as D1, individually or in small bunches, into position between a feeder roller 18A and a scrubber roller 18B which serve as separators to separate bunched documents so that they may be transported individually for control by successive pairs of rollers such as 20A, 20B. Roller 18A is driven by belt 16 and roller 18B is driven by a separate motor (not shown). The rollers 18A and 18B are driven in the directions indicated by arrows. The feed roller 20A is driven by a speed-controlled servo motor M2 through a timing belt TB2 as are the rollers 22A–28A.

The servo motor M2 by coupling means including the timing belt TB2 drives rollers 20A, 22A, 24A, 26A and 28A which, in turn, drive the associated idler rollers 20B, 22B, 24B 26B and 28B. The three rollers 24A, 26A and 28A are driven at a higher speed than the rollers 20A and 22A. The speed ratio between the two sets of rollers is fixed by coupling means including a mechanical drive train which comprises the servo motor M2 driving the timing belt TB2 over pulleys having more or fewer teeth according to the speed of rotation desired.

Sensors at S10, S12 . . . S30 are employed to provide information respecting the presence or absence of documents at particular positions along the track. The sensors may comprise phototransistors energized by LED's in a preferred embodiment. The absence of light to a phototransistor is then interpreted to indicate the presence of a document which blocks the light. It will be seen that the principles remain the same where light is reflected from a surface such as that of a drum when no document is present to energize a phototransistor while reflection from the surface of a document will be diverted away from the phototransistor. The information provided by the sensors is used for a variety of purposes including the detection of jamming and, as in the present invention, for measuring the gaps between documents and generating changes in the speed of M2 which will adjust the gap to desired values. Of particular interest to the present invention are the sensor at S14, for detecting gaps between documents at the point where they develop, and the sensor at S18, for detecting the trailing edges of documents as they pass from control by rollers 28A and 28B to control by rollers 30A and 30B.

Figure 2:
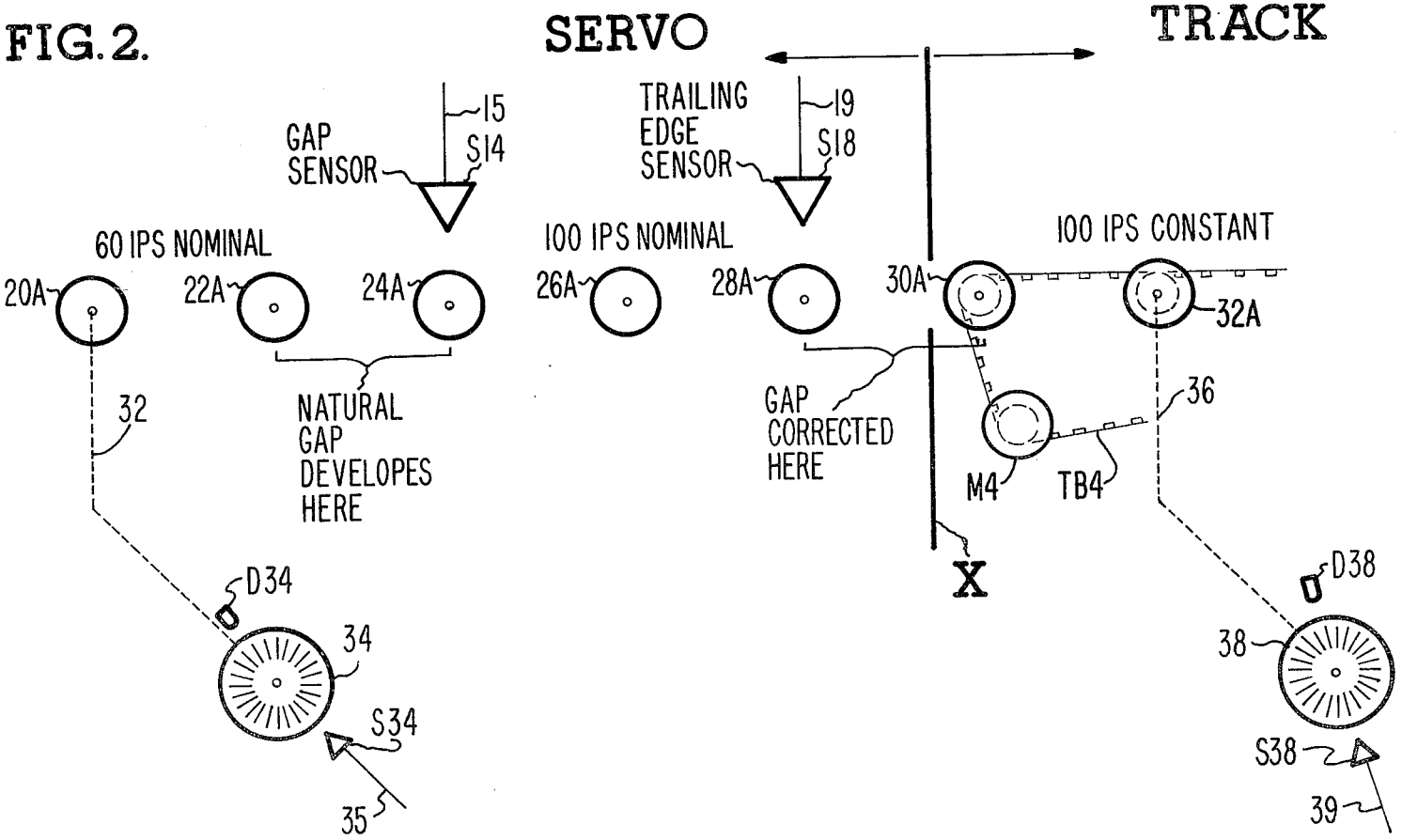
FIG. 2 shows details of relationships between sensors and driving elements of interest to understanding the invention.

FIG. 2 is a diagram showing details of relationships between elements of interest in the practice of the invention. The drive wheel 20A is coupled by a mechanical linkage, indicated by the dashed line 32, to a slotted wheel 34 serving as a source of servo motor clock, or servo clock, signals. In the simplest case the slotted wheel is attached directly to the shaft of 20A. Alternatively, the slotted wheel may be connected directly to the servo motor M2 or to one of the other wheels, such as 28A. The signals are provided by a phototransistor S34 in response to light transmitted from a source such as an LED at D34 through slots of the slotted wheel 34 as the wheel rotates in a plane positioned perpendicular to the path of light between the light source and the phototransistor. Other signals are provided by a photosensor S38 which is energized by light from an LED, D38, which is employed to illuminate a slotted, or timing, disc 38 coupled via linkage 36 to the drive wheel 32A which is driven by a constant speed motor, or servo, M4 through the timing belt TB4. Alternatively, the slotted disc 38 may be connected directly to said constant speed motor or to some other drive wheel such as 30A. The outputs from the associated photosensor S38 form a train of pulses reflecting the constant speed of the track and the drive wheel 32A. In a preferred embodiment, pulses from S34 and S38 are related to the slots on the discs 34 and 38 and to the peripheral speeds of respective drive wheels in such a way that each clock pulse represents a known specific distance, such as 0.05 inch along the track. Direct calculations of speed in inches per second, or other selected values, may then be made by adding or subtracting pulses.

As indicated in FIG. 2, the feeder track may be regarded as having two principle regions; a track region including drive wheels 30A, 32A to the right of vertical line X, and a servo region including drive wheels 20A, 22A, 24A, 26A and 28A to the left of vertical line X. These two regions may be distinguished by the fact that the track region provides a constant speed, such as 100 inches per second to documents, while the servo region provides variable speeds selected to control the length of gaps between documents.

The servo region may be regarded also as including two subregions. In one subregion, drive wheels 20A and 22A operate at a lower speed imparting a nominal speed to documents, of e.g. 60 inches per second, and in the other subregion drive wheels 24A, 26A and 28A operate at a higher speed providing a nominal speed, for example, of 100 inches per second to documents under their control. As indicated previously, the two parts of the servo region are controlled by a single servo motor M2 which gives them a constant speed ratio as the speed of the servo motor is changed.

As indicated by the brackets spanning the space between 22A and 24A, a natural gap develops between documents as a leading document speeds-up under control of wheels 24A, 26A and 28A while the next document is still controlled by 20A and 22A. This natural gap is completed when the second document passes under control of 24A and 24B.

When a document leaves control of the servo section, i.e. when its trailing edge moves out of contact with drive wheel 28A, sensor S18 detects the departure. In response to the depart signal from S18, the controller is enabled to adjust the speed of the servo section and change the gap between the just departed document and the succeeding document. Parameters are selected to enable adjustment of the gap to a desired value and return of the high speed section of the servo to track speed before the next document contacts the first track wheels 30A and 30B. In other words, adjustment of the gap is completed during a period between the time the trailing edge of the first document passes the trailing edge sensor and the time the leading edge of the second document passes the first 100 inches per second sensor S20, as indicated by the bracket between wheels 28A and 30A, and then the speed is adjusted so that the following document reaches the track at track speed. In this way, the desired gap is established and the second document is returned to the correct speed when it comes under control of the track section.

Figure 3A:
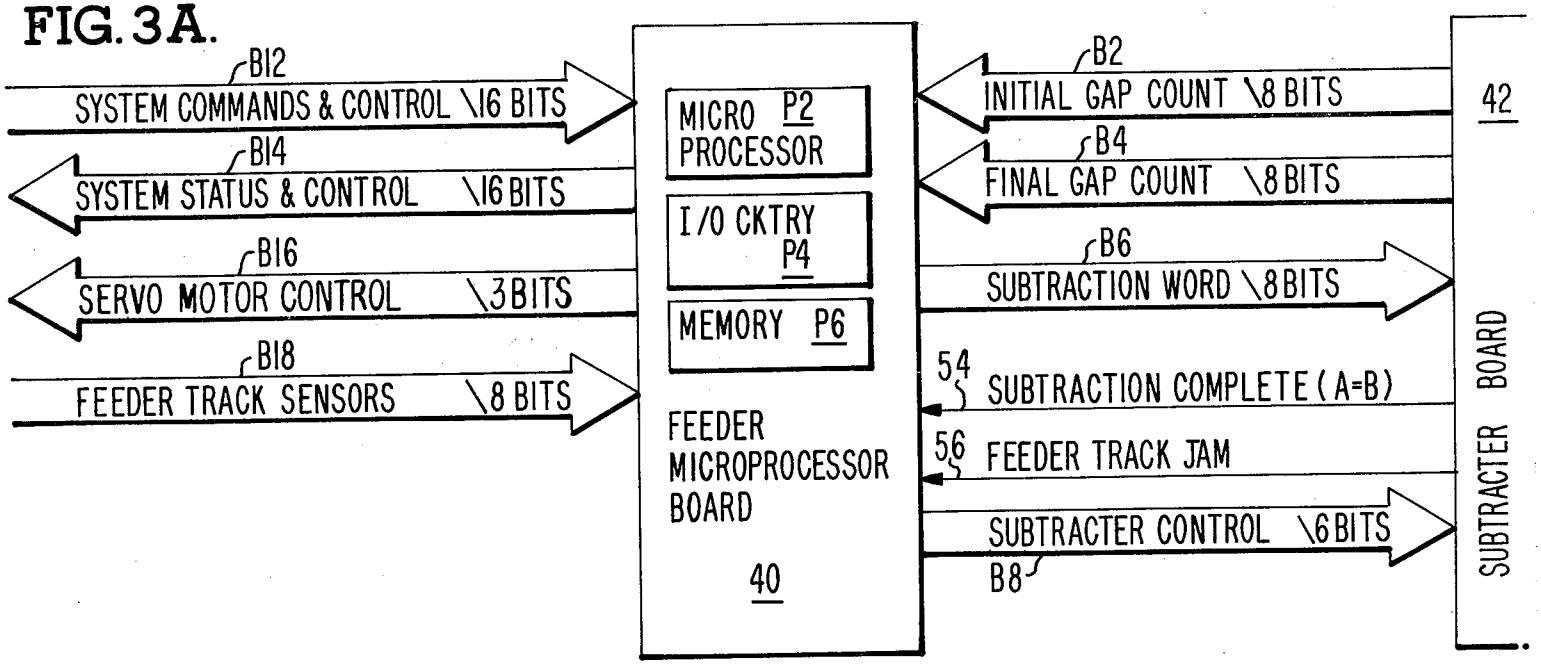
FIGS. 3A and 3B taken together form a block diagram illustrating relationships between microprocessors, counters, memories and other electronic components employed in the practice of the invention.
Figure 3:
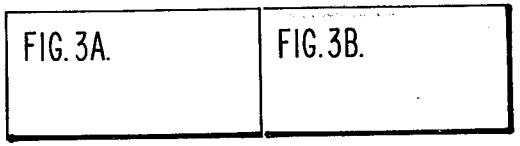
FIG. 3 is a block diagram showing relationships of FIGS. 3A and FIG. 3B to each other.
Figure 3B:
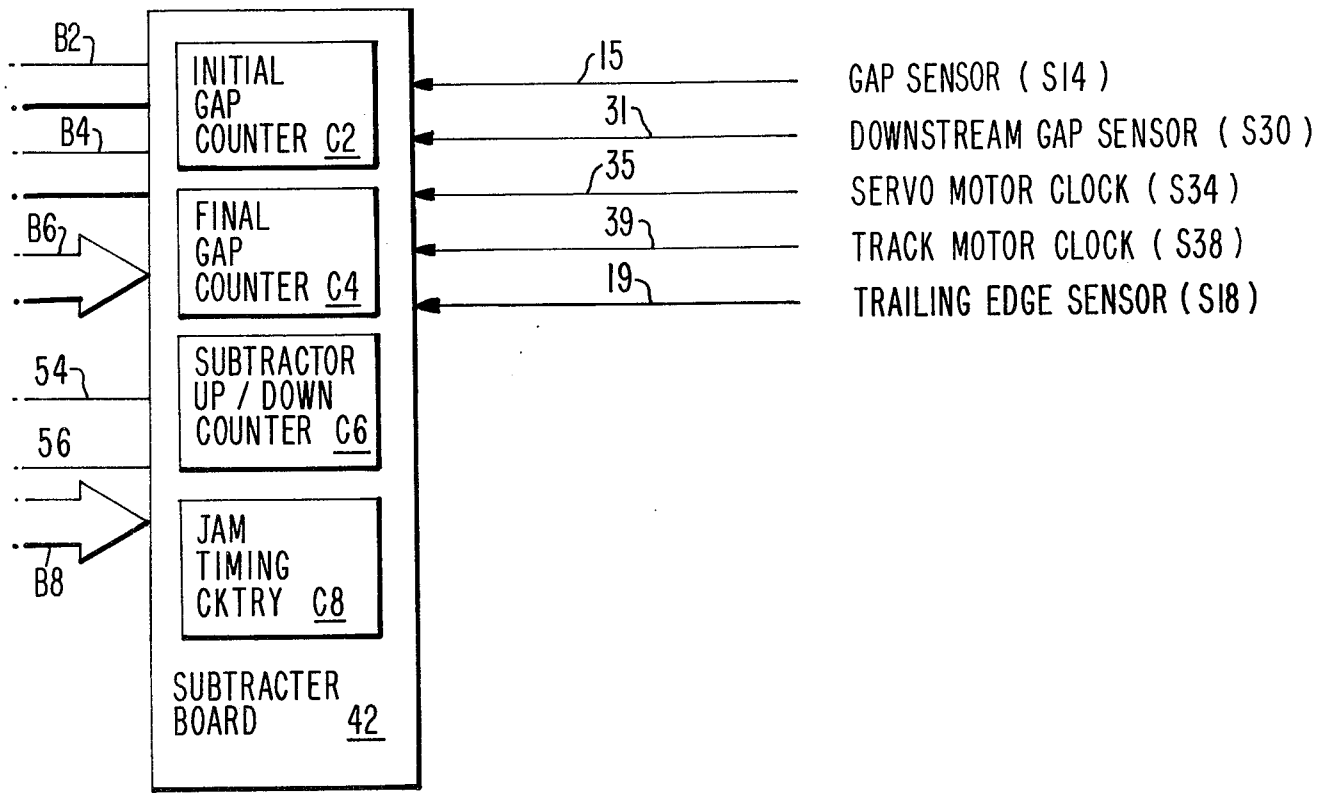

FIGS. 3A and 3B taken together, as shown in FIG. 3, form a block diagram illustrating relationships between microprocessors, counters, memories and other electronic components employed in the practice of the invention. Two printed circuit boards may be employed as a matter of choice to support the components, as indicated at 40 and 42, though a single board or a larger number of boards could be employed as well.

In the configuration shown in FIG. 3A, board 40, labelled a "Feeder microprocessor board" supports a microprocessor such as an Intel 8035 at P2 with supporting input/output circuitry at P4 and a memory at P6. Board 42, labelled "subtractor board" includes an initial gap counter C2, a final gap counter C4, and a combination subtractor and up/down counter C6.

As indicated in FIG. 3B of the drawings, the subtractor board 42 supports elements which are coupled over lines 15, 31, 35, 39 and 19, from respective sensors S14, S30, S34, S38 and S18. Detailed connections to other sensors such as those to sensors S10, S12, S16 . . . S28 are not indicated, since those sensors are used to provide inputs enabling measurement and control of aspects of the apparatus which are not of direct interest to the present invention.

The gap sensor S14 detects when the trailing edge of a first document passes. At that time, over line 15 it provides a signal which enables the initial gap counter C2 to start counting servo motor clock pulses received over line 35 from sensor S34. This count continues until the leading edge of a second document passes the sensor S14 providing a signal over line 15 and causing the counter C2 to stop counting. The final count developed in C2, indicating the length of the natural or initial gap between the first and second documents, is made available over the bus B2 to the microprocessor P2 on the feeder processor board 40, where it is available for processing, as indicated below. As indicated below, this information is used to vary speed of the servo motor after a signal over bus B18 from trailing edge sensor S18 establishes that the first document is clear of the servo system. Since each count from the servo sensor corresponds to a specific distance, such as 0.05 inches, the count will provide a direct measurement of the length of the gap in inches, or metric units, if desired. This measurement can then be used by the processor, through comparison with inputs indicating the desired gap length, to determine whether the gap is too long, too short or within allowable limits.

When a determination is made by the processor that a gap is of the desired length at the time the first document passes the trailing edge sensor S18, no correction is necessary and the servo motor is allowed to continue operating at its normal speed. If the processor determines that the gap is not of the proper length, within certain tolerances, at the time the first document passes the trailing edge sensor S18, the processor will apply a correction over bus B16 to the servo motor and will supply correction signals over B6 and B8 to the subtractor up/down counter C6, which is detailed in FIG. 4.

Two cases exemplary of the steps followed in correcting for a too-short and too-long gap are presented in the following, where the desired gap is six inches:

Case 1:

(1) Initial gap=4.8 inches supplied over B2.

(2) Microprocessor does subtraction to determine what correction is necessary:
6−4.8=1.2 inch correction necessary (3) Microprocessor divides:
1.2 by 0.05=24, indicating that trailing document must slow down by 24 clocks.

(4) Microprocessor commands motor M2 to slow down over bus B16.

(5) Microprocessor determines track motor clock must count up and servo motor clock must count down to correct the gap.

(6) Microprocessor informs subtractor up/down counter C6, and elements 44 and 50 therein, over B8 of required up/count and down/count.

(7) Microprocessor provides subtraction word over B6 for use in comparator 52 of C6 in the determination of when correction has been completed.

(8) Up/down counter 50 in response to up/down counts over 46 and 48 transmits results of its operation over B10 to 8-bit comparator 52.

(9) When input of subtraction word from B6 equals input over B10 from up/down counter 50 subtraction complete signal (A=B) is supplied over 54 to the microprocessor.

(10) Microprocessor returns speed of motor M2 to normal over B16.

(11) Motor advances document at 100 inches per second into constant speed portion of track.

Case 2:

(1) Initial gap=7.8 inches.

(2) Microprocessor subtracts:
7.8−6=1.8 inch correction needed.

(3) Microprocessor divides:
1.8 by 0.05=36 clocks (4) Microprocessor commands motor M2 to speed up over bus B16 in order to shorten gap.
(5) Microprocessor determines track motor clock must count down and servo motor clock must count up to correct the gap.
(6) Microprocessor informs clock switch circuitry 44 over B8 of required up/count and down/count.
(7) Microprocessor provides subtraction word over B6 for use in comparator 52 in the determination of when correction has been completed.
(8) Up/down counter 50 in response to up/down counts over 46 and 48 transmits results of its operation over B10 to 8-bit comparator 52.
(9) When input of subtraction word from B6 equals input over B10 from up/down counter 50 subtraction complete signal (A=B) is supplied over 54 to the microprocessor.
(10) Microprocessor returns speed of motor M2 to normal over B16.
(11) Motor advances document at 100 inches per second into constant speed portion of track.

The gap sensor S30, located in the track section of the system downstream from the servo section of the system, detects the trailing edge of each document as it passes. It also detects the leading edge of each succeeding document. It provides signals for each occurrence over line 31 to a final gap counter C4 which measures the number of pulses between the passage of the trailing and leading edges in each case and routes the final gap count over bus B4 to the microprocessor.

Based on gap requirements established by the operator and on data over B2 from the initial gap counter C2 and over B4 from the final gap counter C4, the microprocessor derives a subtraction word which indicates the number of counts, corresponding to the number of fractions of an inch, by which gaps between the documents must be decreased or increased. The subtraction word is supplied over bus B6 to the Subtracter circuit C6. The processor also supplies to circuit C6 over bus B6 an up/down select signal designating whether servo motor clocks should be subtracted from track motor clocks or vice versa.

Figure 4:
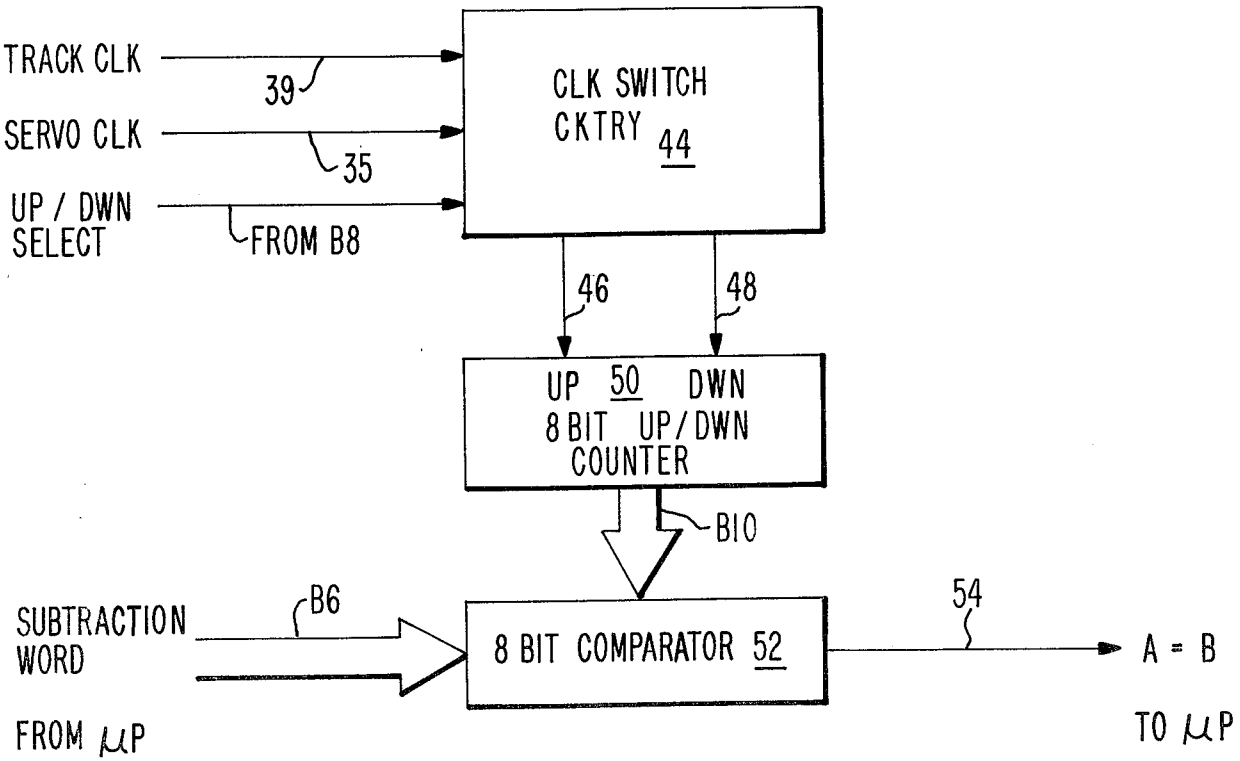
FIG. 4 is a block diagram showing the arrangement of elements of a subtracter and up/down counter depicted as a single block in the arrangement of FIG. 3B.

The arrangement of the Subtractor up/down counter C6 is shown in a block diagram in FIG. 4. The track clock pulses are supplied over line 39, the servo clock pulses are supplied over line 35 and the up/down select signals are supplied over the bus B8 to a clock switch circuit at block 44. Outputs designating up-count on line 46 and down-count on line 48 are supplied to up-count and down-count terminals, respectively, of an 8-bit up/down counter 50 comprising a first type 74193 4-bit up/down counter which feeds overflow to a second type 74193. The outputs of the up/down counter 50 are coupled by bus B10 as inputs to an 8-bit comparator 52 comprising two 4-bit 7485 comparators. Reference may be made to previously recited patent application Ser. No. 155,053 for details of similar circuits. When a sufficient number of clock pulses has been subtracted so that there is a match between inputs over B10 and over B6, the A=B signal will be supplied over line 54 to the processor. The motor M2 will be restored to normal speed and the document in the servo section will be advanced into the track section.

Signals from a number of feeder track sensors are supplied over bus B18 to the system for use in detecting jamming of documents in the track. These signals are used by the processor and the jam timing circuitry C8 to determine when jamming occurs. Signals from C8 over line 56 are used by the processor to establish the existence and nature of jamming conditions, based upon which the processor can institute procedures over busses B14 and B16 to cope with the problems. Commands and indications of desired controls to apparatus according to the present invention are supplied over bus B12.

What is claimed is:

1. In a document feeder including a plurality of rollers arranged as part of a track in successive pairs where first and second pluralities of pairs of rollers are driven at different speeds by servo means maintaining a constant speed ratio between the speed of the first and the second pluralities of pairs and a third plurality of pairs of rollers are driven at a constant speed, control means comprising:

first sensing means associated with the second plurality of rollers for detecting passage of the trailing edge of a first document and providing a first signal indicating that passage;

said first sensing means providing a second signal indicating when the leading edge of a second document passes;

processor means coupled to be responsive to said first and second signals to determine the length of the gap between the respective trailing and leading edges of the first and second documents; and second sensing means associated with the second plurality of rollers for providing a third signal indicating the passage of the trailing edge of the first document as it leaves the control of the second plurality of rollers;

said processor means responding to said third signal to provide a servo motor control signal altering the speed of the servo means and thereby producing changes in the length of the gap until a gap of required size is obtained; and said processor means, after the required gap is obtained, changing the speed of said servo means to a speed imparting the transport speed to the document for entry into control by the constant speed third plurality of rollers.

2. In a document feeder, a system providing improved control over the spacing between successive documents carried by a track in the feeder, comprising:

first and second pluralities of rollers associated with the track;

servo means driving said rollers through coupling means arranged to drive said second plurality of rollers at a higher speed than that of the first plurality of rollers and to maintain a constant speed ratio between the speed of the first and second plurality of rollers;

a third plurality of rollers positioned after the second plurality of rollers in the track and driven at a constant speed independently by motor means to impart a constant transport speed to documents in the track;

first sensing means associated with the second plurality of rollers for detecting passage of the trailing edge of a first document and providing a first signal indicating that passage;

said first sensing means providing a second signal indicating when the leading edge of a second document passes;

processor means coupled to be responsive to said signals to determine the length of the gap between the respective trailing and leading edges of the first and second documents; and second sensing means associated with the second plurality of rollers for providing a third signal indicating the passage of the trailing edge of the first document as it leaves the control of the second plurality of rollers;

said processor means responding to said third signal to provide a servo motor control signal altering the speed of the servo means and thereby altering the length of the gap until a gap of required size is obtained;

said processor means, after the required gap is obtained, changing the speed of said servo means to a speed imparting the transport speed to the document for entry into contact with the constant speed third plurality of rollers.

3. In a document feeder including a track along which documents move, a system providing improved control over the spacing between successive documents carried by a track in the feeder, comprising:

a first plurality of rollers associated with the track;

first servo means coupled to drive said first plurality of rollers at a variable speed;

a second plurality of rollers associated with the track;

said first servo means including coupling means to drive said second plurality of rollers at a speed set higher than that of the first rollers and to maintain a constant speed ratio between the speed of the first and second plurality of rollers;

a third plurality of rollers following the second plurality of rollers in the track and driven at a constant speed independently by a second servo means to impart a constant transport speed to documents in the track;

first sensing means associated with the second plurality of rollers for detecting passage of the trailing edge of a first document and providing a first signal indicating that passage;

said first sensing means providing a second signal indicating the passage of the leading edge of a second document;

processor means responsive to said signals to determine the distance between the respective trailing and leading edges of the first and second documents;

second sensing means associated with the second plurality of rollers for providing a third signal indicating the passage of the trailing edge of the first document as it leaves the control of the second plurality of rollers;

said processor means responding to said third signal to provide a signal altering the speed of the first servo means and thereby altering the length of the gap until a gap of required size is obtained; and said processor means changing the speed of said first servo means to a speed imparting the transport speed to the document for entry into the constant speed third plurality of rollers.

4. The invention as claimed in claim 1, 2 or 3, in which the processor means comprises:

a microprocessor;

an initial gap counter coupled responsive to said first and second signals to supply initial gap count signals to the microprocessor indicating the length of the initial gap between documents;

a subtractor including an up/down counter and a comparator coupled for use in determining when the gap has been adjusted to a desired value; and means coupling said microprocessor to supply a subtraction word and subtractor control signals to said subtractor to enable the subtractor to determine when the gap has attained a desired length and to supply a signal to the microprocessor indicating that the gap is of desired length.

5. The invention as claimed in claim 1, 2 or 3, including:

third sensing means associated with the third plurality of rollers for detecting passage of the trailing edge of a first document and providing a fourth signal indicating that passage;

said third sensing means providing a fifth signal indicating the passage of the leading edge when a second document passes;

additional processor means coupled to be responsive to said fourth and fifth signals to determine the final gap between the respective trailing and leading edges of the first and second documents as they pass the third sensing means;

said additional processor means providing final gap count signals indicative of the length of said final gap as measured at the third sensing means; and said processor means responding to said final gap count signals to alter the speed of said first servo means and thereby alter the length of the final gap until a gap of required size is obtained.

6. In a document feeder for accepting documents of varied lengths which are arranged end-to-end and advancing them along a track while imparting the same speed to each document and establishing gaps of equal length between the documents, control means comprising:

means providing track clock pulses and servo clock pulses;

an initial gap counter, coupled responsive to first signals indicating the passage of the trailing edge of a first document, to start counting track clock pulses;

said initial gap counter responding to second signals indicating the arrival of the leading edge of a second document to stop counting track clock pulses and provide a readout indicating the magnitude of the initial gap count between the first and second documents;

microprocessor means responsive to said readout and to inputs designating a desired gap between documents to provide a control signal to track speed control means to start the correction of said gap and provide a word designating the number of clock pulses to be subtracted to correct the length of the gap;

said microprocessor means providing subtracter control signals designating whether track clock pulses or servo clock pulses should be subtracted from the other;

a subtractor and up/down counter coupled to receive said word and said subtractor control signals and perform the designated subtraction between the track clock pulses and the servo clock pulses until equality is established;

said subtractor and up/down counter providing a subtraction complete signal to said microprocessor means to enable the microprocessor to restore the track speed control means to its original speed.

7. The invention as claimed in claim 6, in which:

the track clock pulses and the servo clock pulses have periods directly representative of the same distances along the track;

whereby, the initial gap counter is enabled to make a direct measurement of the length of the gap between the receipt of said first signals and said second signals; and the subtractor up/down counter is able to establish when the gap is of desired length before transmitting the subtraction complete signal.

8. The invention as claimed in claim 6 or 7, comprising:

a final gap counter coupled responsive to third signals, indicating the passage of the trailing edge of a first document downstream, to start counting track clock pulses;

said final gap counter coupled responsive to fourth signals, indicating the passage of the leading edge of a second document downstream, to stop counting track clock pulses and provide a second readout indicating the magnitude of the final gap count between the first document downstream and the second document downstream;

said microprocessor means responsive to said second readout and to said inputs designating a desired gap between documents to provide a correcting control signal to the track control means to adjust the number of clock pulses to be subtracted and to correct the length of the gap;

said microprocessor means supplying corrected subtractor control signals designating whether track clock pulses or servo clock pulses should be subtracted from the other;

said subtractor and up/down counter coupled to receive said corrected word and said corrected subtractor control signals and perform the designated subtraction between the track clock pulses and the servo clock pulses until equality is established;

said subtractor and up/down counter providing a subtraction complete signal to said microprocessor means to enable the microprocessor to restore the track speed control means to its original speed.

* * * * *